US006152716A

United States Patent [19]

Agner

[11] Patent Number: 6,152,716

[45] Date of Patent: Nov. 28, 2000

[54] VANE PUMP

[75] Inventor: Ivo Agner, Bad Homburg, Germany

[73] Assignee: Luk Fahrzeug-Hydraulik GmbH & Co. KG, Germany

[21] Appl. No.: 09/202,573

[22] PCT Filed: Jun. 23, 1997

[86] PCT No.: PCT/EP97/03277

§ 371 Date: Dec. 17, 1998

§ 102(e) Date: Dec. 17, 1998

[87] PCT Pub. No.: WO97/49915

PCT Pub. Date: Dec. 31, 1997

[30] Foreign Application Priority Data

Jun. 21, 1996 [DE] Germany ..... 296 10 896 U
Jul. 20, 1996 [DE] Germany ..... 296 12 578 U

[51] Int. Cl.[7] ..... E04C 2/00

[52] U.S. Cl. ..... 418/132; 418/133; 418/268; 418/16

[58] Field of Search ..... 418/133, 132, 418/268, 82, 80, 16

[56] References Cited

U.S. PATENT DOCUMENTS

| | | | |
|---|---|---|---|
| 3,761,206 | 9/1973 | Fierstine | 418/16 |
| 3,787,151 | 1/1974 | Carlson | 418/133 |
| 4,505,654 | 3/1985 | Dean, Jr. et al. | 418/80 |
| 4,772,190 | 9/1988 | Merz et al. | 418/133 |
| 5,147,183 | 9/1992 | Gettel . | |
| 5,266,018 | 11/1993 | Niemiec | 418/82 |
| 5,924,856 | 7/1999 | Murayama et al. | 418/133 |

FOREIGN PATENT DOCUMENTS

| | | |
|---|---|---|
| 2835816 | 2/1980 | Germany . |
| 59-028853A | 2/1984 | Japan . |
| 01155096 | 6/1989 | Japan . |
| 2002454 | 2/1979 | United Kingdom . |

*Primary Examiner*—Thomas Denion
*Assistant Examiner*—Thai-Ba Trieu
*Attorney, Agent, or Firm*—Ostrolenk, Faber, Gerb & Soffen, LLP

[57] ABSTRACT

The invention relates to a vane pump with a rotor which receives vanes, with two pressure plates (17) which bear sealingly on the rotor and of which one is arranged on a delivery side of the vane pump and one on the opposite side, and with a contour ring surrounding the vanes and forming two suction and discharge regions, at least one of the two pressure plates being provided with inlet and outlet orifices (53, 59, 63*a, b*) which make a fluid connection between a discharge region and an undervane region. The invention is distinguished in that the pressure plate (17.2) located opposite the delivery side has an orifice, which makes a fluid connection between a discharge region and a pressure space (61) partially delimited by this pressure plate (17.2), and seals off the pressure space (61) relative to the other discharge region.

10 Claims, 4 Drawing Sheets

VANE PUMP

Figure 1:
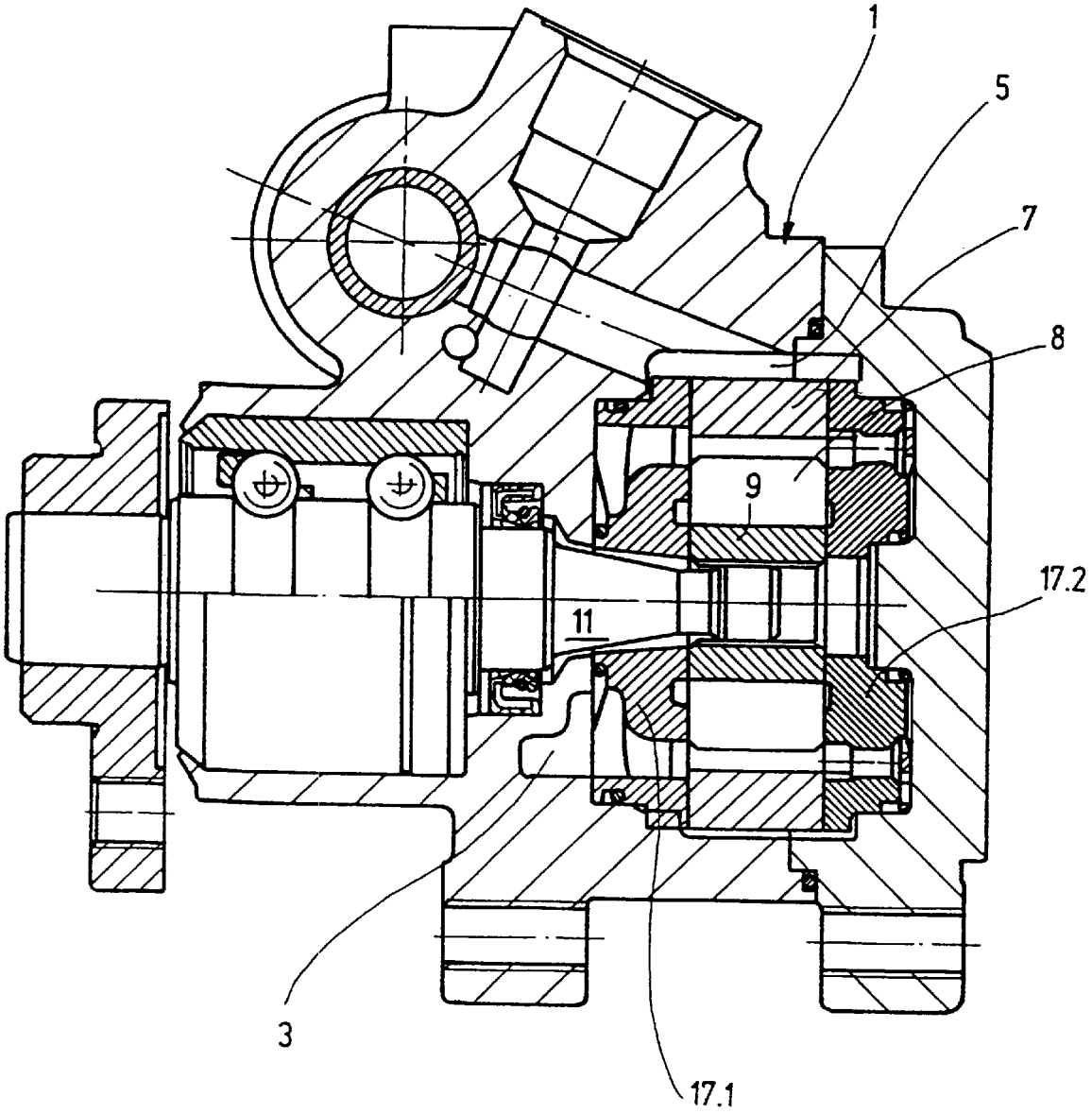

The invention relates to a vane pump according to the preamble of claim 1.

Vane pumps of the type referred to here are known. They have a rotor, in the circumferential wall of which slots which receive vanes are formed. The rotor rotates within a contour ring which forms preferably two crescent-shaped delivery spaces, through which the vanes run. When the rotor rotates, spaces of increasing and decreasing size are obtained. When the vane pump is in operation, therefore, suction and discharge regions are obtained. in the case of a contour ring of the type referred to here, there are two separate pump portions, each with a suction and a discharge region.

The discharge region is delimited laterally, on the outlet or delivery side, by means of a sealingly bearing pressure plate and, on the side located opposite the delivery side, for example by the casing of the vane pump.

When a vane pump is stopped while it is running hot, the upper vanes slide, due to gravity, into the slots formed in the rotor. The separation provided between the suction and discharge regions is thereby canceled, and there is virtually a short circuit in one pump portion, namely the upper. On the opposite side, as a consequence of gravity, the vanes slide out of their slots or they remain outside, so that separation is maintained here.

When the fluid, for example hydraulic oil, delivered by the vane pump cools, then, its viscosity increases, so that the movability of the vanes diminishes. When the pump is put into operation, the still separated pump portion admittedly delivers the fluid. However, the delivery capacity is greatly reduced, since there is a hydraulic connection from the delivering lower discharge region to the opposite upper discharge region and, there, to the suction region.

If the discharge regions are sealed off by means of the casing, undesirable leakage often occurs, since the casing is bent away from the rotor by the pressure prevailing within the contour ring and the leakage gap therefore becomes larger. The leakage is reduced by using a further pressure plate, instead of sealing off by means of the casing. This pressure plate is designed essentially identically to the pressure plate on the outlet or delivery side and has ducts which in each case open into the discharge regions of the two pump portions and make a connection with a pressure space formed between the pressure plate and casing.

The problem mentioned, regarding the short circuit when the pump is started up, arises to an increased extent in this embodiment, since, in addition to the connection on the delivery side between the discharge regions, there is also a corresponding hydraulic connection on the side located opposite the delivery side.

The object of the invention is, therefore, to provide a vane pump which has very good cold starting properties and, furthermore, has very little tendency to leakage.

This object is achieved with the aid of a vane pump which comprises the features mentioned in claim 1. The vane pump has two pressure plates bearing sealingly on the rotor, the pressure plate located opposite the delivery side having an orifice which makes a fluid connection between a preferably lower discharge region and a closed-off pressure space. A pressure is thereby built up in this pressure space, said pressure bending the pressure plate somewhat toward the rotor and pressing it sealingly onto the rotor. The pressure built up in the delivery region results in the same way in the pressure plate on the delivery side being subjected to a force which presses this pressure plate sealingly onto the rotor. Furthermore, a short circuit between the two discharge regions via the pressure space is avoided by connecting to the pressure space only one of the two discharge regions in the pressure plate located opposite the delivery side. The other discharge region of the pump is sealed off relative to the pressure space by means of the pressure plate.

In an advantageous embodiment, at least one of the fluid connections in the pressure plate located opposite the delivery side has a passage area which is smaller than ⅓ of the passage area of the outlet orifice of the delivery-side pressure plate.

In a further advantageous embodiment of the invention, the pressure plate, which closes off the pressure space and which comprises an orifice for connecting the lower discharge region to the pressure space, has a further relatively small orifice which opens from the pressure space into the other upper discharge region. With the aid of this orifice, the pressure space can be vented when the pump is commissioned, with the advantageous result that noise is reduced. In order to prevent a short circuit via this vent orifice, the latter must be designed in such a way that it has very high hydraulic resistance to a cold fluid of high viscosity.

In a further advantageous embodiment, an orifice is provided on the pressure plate located opposite the delivery side, said orifice connecting the discharge region which is upper in the installed position to the pressure space. The lower discharge region is sealed off relative to the pressure space by means of the pressure plate.

In an advantageous embodiment, also, the pressure plate located opposite the delivery side is provided with two orifices which each make a connection between a discharge region and the pressure space and which have high hydraulic resistance. In this case, the sum of the two resistances must exceed a value which is necessary for avoiding a short circuit in the cold starting phase.

Further advantageous embodiments of the invention may be gathered from the subclaims.

Figure 2B:
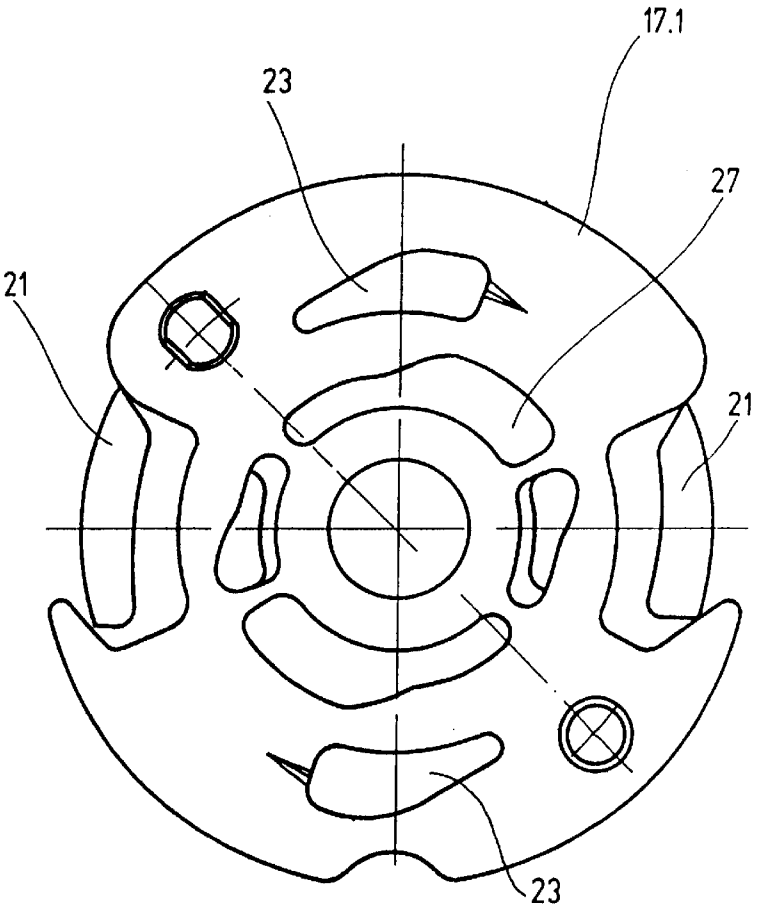
Figure 2A:
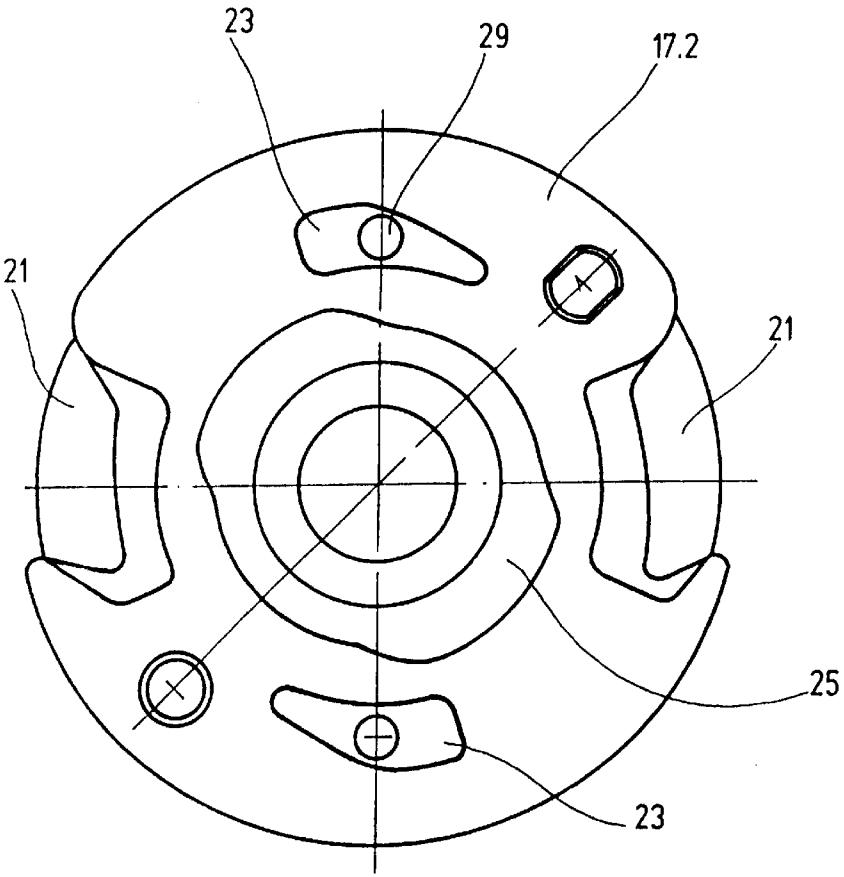

The invention is explained in more detail by means of exemplary embodiments with reference to the drawing in which:

FIG. 1 shows a diagrammatic sectional illustration of a vane pump;

FIGS. 2*a*, and 2*b* show two pressure plates of the vane pump, and

FIGS. 3*a*–3*f* show diagrammatic illustrations of four differently designed vane pumps.

For a better understanding, the design of a vane pump will first be dealt with in general terms with reference to FIG. 1. This vane pump comprises a casing 1, in which a duct 3 leading to an outlet is provided. A consumer, for example a steering assistance device, is supplied with a fluid, for example hydraulic oil, via the outlet.

The casing has a circular interior 5 receiving a contour ring 7 and a rotor 9, in the circumferential surface of which slots which receive vanes 8 are formed. The rotor 9 is set in rotation via a drive shaft 11, so that the vanes 8 move within the contour ring 7, the interior 5 of which is designed in such a way as to form two crescent-shaped free spaces, also designated as delivery spaces, through which the vanes run. So-called vane cells, which decrease and increase in size during rotation of the rotor, are located in each case between two vanes which are adjacent, as seen in the circumferential direction. Suction and discharge regions are thereby formed. The end faces of the contour ring 7 and of the rotor 9 bear on sealing surfaces which are formed by pressure plates 17.1 and 17.2. The pressure plate 17.1 facing the delivery side is designated below as the delivery-side pressure plate and the other pressure plate 17.2 as the pressure chamber-side pressure plate. The unit formed from the two pressure plates 17.1 and 17.2, the contour ring 7 and the rotor 9 is therefore located in the interior 5 of the casing. At least the delivery-side pressure plate 17.1 facing the duct 3 or outlet is designed in such a way that the hydraulic oil delivered by the vane cells is delivered through the pressure plate and passes into an outlet region, formed between the pressure plate and the inside of the casing, and from there to the consumer.

The vane pump is designed in such a way that, in the discharge region, the hydraulic oil arrives at the vane undersides located in the interior of the rotor, the so-called undervane region, and subjects these to pressure. As a result of the overpressure prevailing in the undervane region, the vanes are pressed out of the slots radially outward and thus bear sealingly on the inside of the contour ring.

Those surfaces of the two pressure plates 17.1 and 17.2 which face the rotor 9 are illustrated in a top view in FIGS. 2*a* and 2*b* respectively. Two suction regions 21 and two kidney-shaped discharge regions 23 can in each case be seen clearly. An essentially annular groove 25 for the undervane regions is provided further inward in the pressure space-side pressure plate 17.2 according to FIG. 2*a*. By contrast, four independent grooves 27 essentially in the form of an annular segment are designed in the delivery-side pressure plate 17.1 according to FIG. 2*b*.

It can also be seen from FIG. 2*a* that the kidney-shaped discharge regions 23 of the pressure space-side pressure plate 17.2 merge into round ducts 29. At least one or both ducts 29 have a passage area, that is to say a cross-sectional throughflow area, which is less than ⅓ of the passage area of the discharge regions 23 of the delivery-side pressure plate 17.1.

Figure 3:
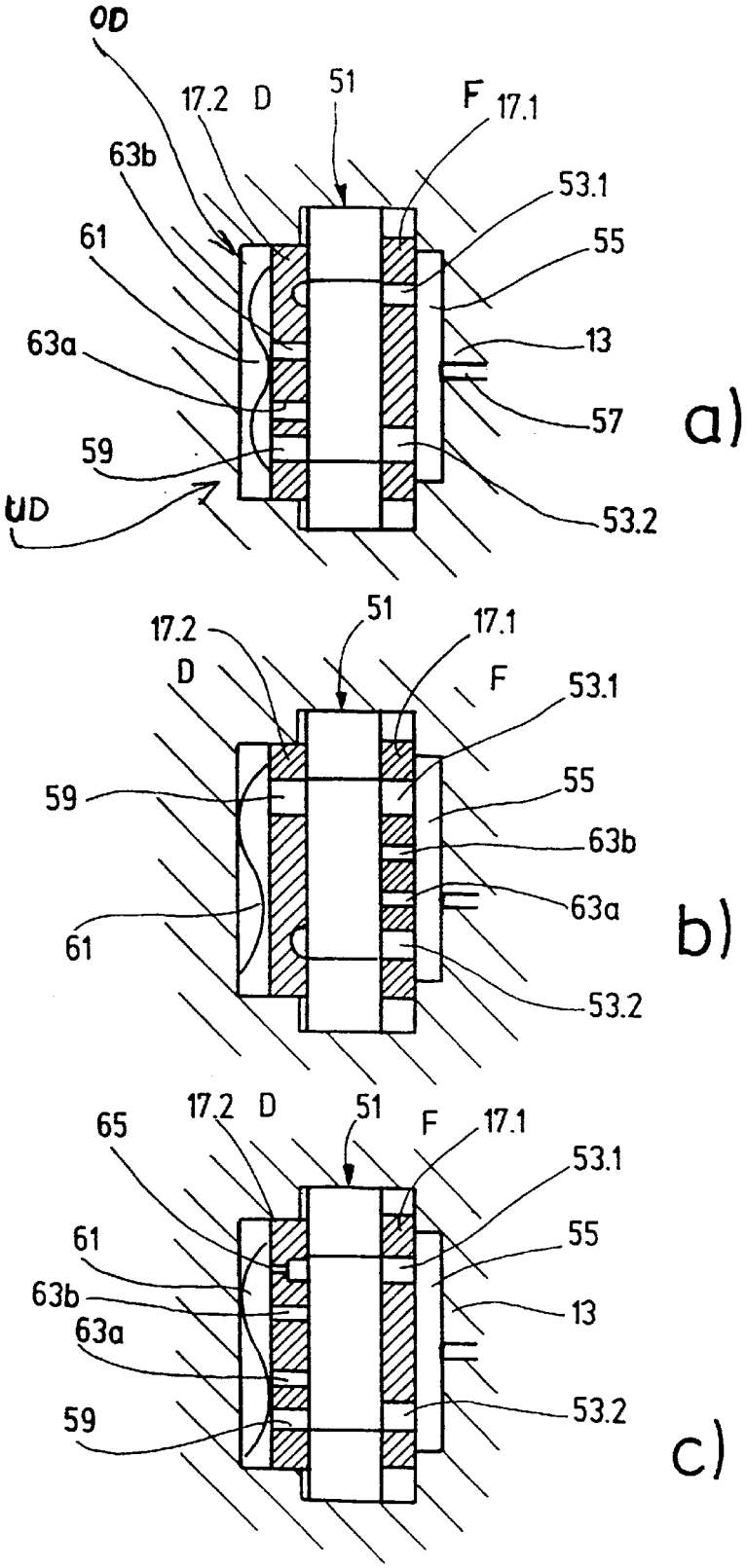
Figure 3:
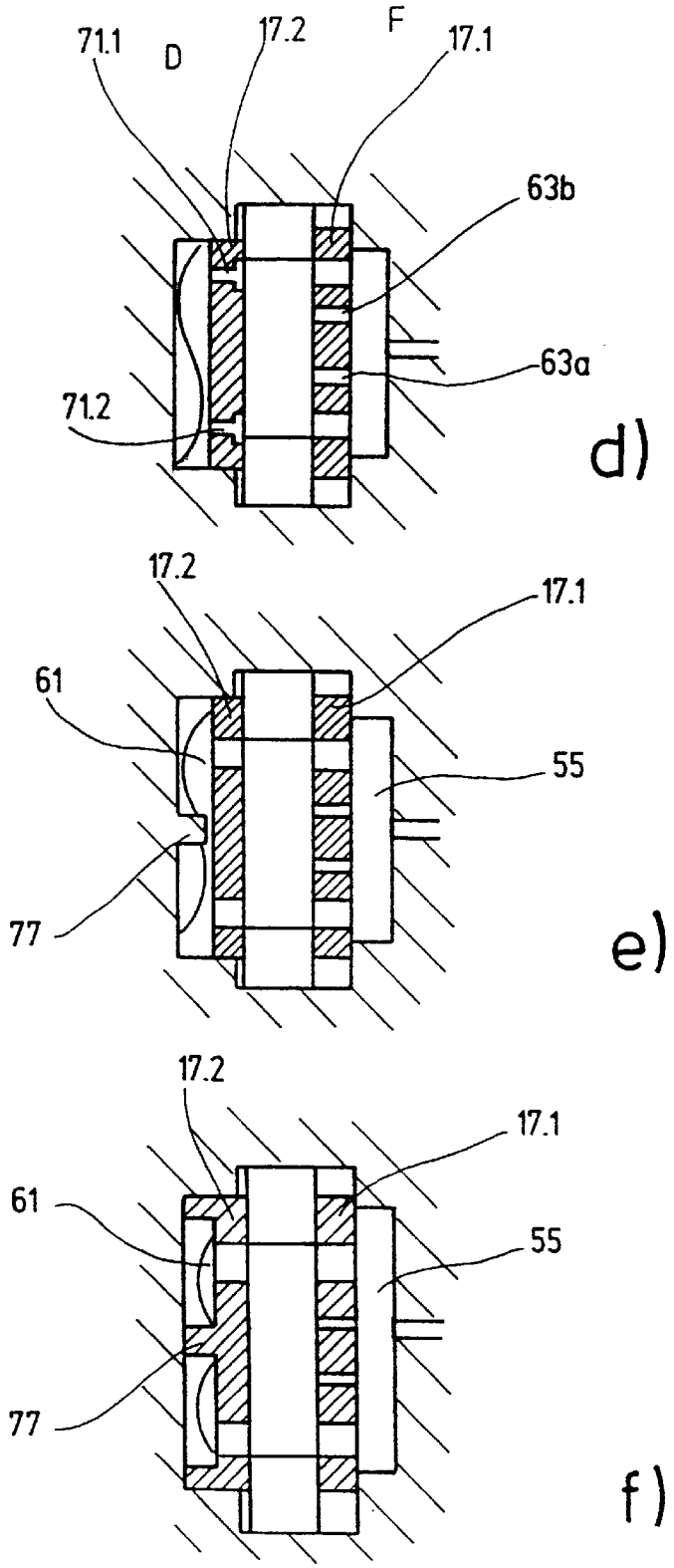

FIG. 3 illustrates four different embodiments of the vane pump in a highly simplified way, essentially the different designs of the pressure plates being significant. For this reason, the remaining details, in particular the rotor, vane, shaft, etc., are not illustrated.

The vane pump according to FIG. 3*a* has a pressure plate 17.1 and 17.2 respectively both on the outlet or delivery side F of the rotor and on the opposite pressure space side D. The two pressure plates 17 bear sealingly on the contour ring and rotor 51 and are therefore intended to prevent hydraulic oil from leaking out of the discharge regions.

Illustration of the delivery-side pressure plate 17.1 in FIG. 3*a* reveals two outlet ducts 53.1 and 53.2 which in each case make a fluid connection between a discharge region and a delivery or outlet region 55.

On the opposite side, the pressure space-side pressure plate 17.2 bears on the rotor 51. It likewise has a duct 59 which makes a fluid connection between a discharge region UD, the lower in the Figure, and a pressure space 61. This pressure space 61 is formed, on the one hand, by the pressure space-side pressure plate 17.2 and, on the other hand, by the casing.

Furthermore, other orifices 63*a*, 63*b* are provided in the pressure space-side pressure plate 17.2, said orifices opening into the respective undervane region of the vanes. A fluid connection is thereby made between the lower discharge region and at least one undervane region.

It can be seen clearly in FIG. 3*a* that the pressure space-side pressure plate 17.2 does not have a duct assigned to a discharge region OD which is the upper in the Figure. This upper discharge region is therefore not connected to the pressure space 61. A short circuit in the starting phase between the upper discharge region, in which the short circuit prevails, and the lower discharge region is prevented in this way. It is presupposed, in this case, that appropriate measures for preventing a short circuit are also taken on the delivery side. Thus, for example, hydraulic resistances, designed as webs or plates, on the delivery side prevent fluid from flowing from the lower discharge region into the upper discharge region or the outlet region in the cold starting phase.

The embodiment shown in FIG. 3*b* differs from that described above only in that the orifice 63 opening into the undervane region is not provided in the pressure space-side pressure plate 17.2, but in the delivery-side pressure plate 17.1. Furthermore, the duct 59 of the pressure plate 17.2 is not assigned to the lower discharge region, but to the upper discharge region. However, this does not result in any change in the mode of operation of the two pressure plates after the starting phase. A third embodiment can be seen in FIG. 3*c*, this being essentially identical to the embodiment illustrated in FIG. 3*a*.

It differs, however, in that, in the pressure space-side pressure plate 17.2, a small duct 65 is provided, which serves essentially for venting and which makes a connection between the pressure space 61 of the upper discharge region. In this case, the cross section of the duct 65 is dimensioned in such a way that its hydraulic resistance, in particular to cold hydraulic oil of high viscosity, is very high. The resistance should, at all events, be so high that, in the cold starting phase, an oil stream from the lower discharge region via the pressure space 61 and the duct 65 into the upper discharge region, where the short circuit prevails, and then into the suction region is virtually prevented.

The function of this vent duct 65 is to allow air accumulating in the upper region of the pressure space 61 to escape. This vent duct 65 must therefore be assigned to the upper discharge region. A reduction in noise can be achieved by means of the venting of the pressure space 61 which is thus achieved.

FIG. 3*d* shows a further exemplary embodiment, in which the pressure space-side pressure plate 17.2 has two ducts 71. The upper duct 71.1 connects the upper discharge region to the pressure space 61 and the lower duct 71.2 connects the lower discharge region to the pressure space 61. In this case, the cross sections of the two ducts 71 are selected in such a way that the sum of the two individual hydraulic resistances to a viscous cold oil is such that virtually no oil stream develops between the two discharge regions through the pressure space 61.

Consequently, as regards the venting function, this pump is positionally independent, since a vent duct, through which the accumulating air can escape, is in each case located in the upper region of the pressure space, irrespective of the installation position.

FIGS. 3*e* and 3*f* show two further exemplary embodiments of how it is possible, on the pressure space side, to produce a hydraulic resistance which, for example, can be used instead of the small cross sections according to FIG. 3*d*. Thus, on the one hand, a web 77 can be provided on the casing, said web delimiting the oil stream in the cold starting phase between the lower and the upper discharge region. In addition to arranging the web 77 on the casing, said web may, of course, also be designed on the pressure plate 17.2, as shown in FIG. 3*f*. Other embodiments of a hydraulic resistance may, of course, also be envisaged.

What is claimed is:

1. A vane pump with a rotor which receives vanes, with two pressure plates which bear sealingly on the rotor and of which one is arranged on a delivery side of the vane pump and one on the opposite side, and with a contour ring surrounding the vanes and forming two suction and discharge regions, at least one of the two pressure plates being provided with first inlet and outlet orifices which make a first fluid connection between a discharge region and an undervane region, wherein the pressure plate located opposite to the delivery side is provided with second inlet and outlet orifices which make a second fluid connection between one of said discharge regions and a pressure space partially delimited by the pressure plate located opposite to the delivery side, and the pressure plate located opposite to the delivery side seals off the pressure space relative to the other discharge region or comprises a hydraulic resistance between the discharge regions.

2. The vane pump as claimed in claim 1, comprising two second fluid connections formed in the pressure plate located opposite to the delivery side, wherein at least one of the second fluid connections in the pressure plate located opposite to the delivery side has a passage area which is smaller than ⅓ of a passage area of an outlet orifice of a further second fluid connection formed in the opposite pressure plate.

3. The vane pump as claimed in claim 1, wherein the pressure plate located opposite to the delivery side has a vent duct which is upper in the installation position and which connects the pressure space to the other discharge region and has a cross section that said duct has high hydraulic resistance to a cold fluid of high viscosity.

4. The vane pump as claimed in claim 1, wherein the first and second fluid connections are provided in the pressure plate located opposite to the delivery side.

5. The vane pump as claimed in claim 1, wherein, the first fluid connection connecting the pressure space and at least one undervane region is provided in the delivery side pressure plate, and wherein the pressure plate located opposite to the delivery side seals off the pressure space relative to the undervane region.

6. The vane pump as claimed in claim 1, wherein one of the discharge regions which is the upper in relation to the installation position is fluidically connected to the pressure space.

7. The vane pump as claimed in claim 1, wherein one of the discharge regions which is the lower in relation to the installation position is fluidically connected to the pressure space.

8. The vane pump as claimed in claim 1, wherein the two discharge regions are fluidically connected to the pressure space, the second fluid connections in the pressure plate located opposite to the delivery side being dimensioned in such a way that the sum of the two hydraulic resistances to a cold fluid is such that a fluid stream is prevented.

9. The vane pump as claimed in claim 1, wherein, on the side of the pressure plate located opposite to the delivery side, a web is provided in the casing or in the pressure plate, said web forming a high hydraulic resistance in order to prevent a short circuit between the two discharge regions.

10. The vane pump as claimed in claim 1, wherein on the side of the pressure plate located opposite to the delivery side, a web is provided in the casing and in said pressure plate, said web forming a high hydraulic resistance in order to prevent a short circuit between the two discharge regions.

* * * * *